US006817839B2

(12) United States Patent
Hauser

(10) Patent No.: US 6,817,839 B2
(45) Date of Patent: Nov. 16, 2004

(54) DEVICE FOR DELIVERING MOIST GASES

(75) Inventor: Erwin Hauser, Emmendingen (DE)

(73) Assignee: KNF Neuberger GmbH, Freiburg (DE)

( * ) Notice: Subject to any disclaimer, the term of this patent is extended or adjusted under 35 U.S.C. 154(b) by 19 days.

(21) Appl. No.: 10/275,241

(22) PCT Filed: Apr. 30, 2001

(86) PCT No.: PCT/EP01/04884

§ 371 (c)(1),
(2), (4) Date: Nov. 4, 2002

(87) PCT Pub. No.: WO01/83990

PCT Pub. Date: Nov. 8, 2001

(65) Prior Publication Data

US 2003/0123997 A1 Jul. 3, 2003

(30) Foreign Application Priority Data

May 3, 2000 (DE) ..... 100 21 454

(51) Int. Cl.[7] ..... F04B 25/00
(52) U.S. Cl. ..... 417/251; 417/253; 417/440
(58) Field of Search ..... 417/521, 522, 417/523, 440, 441, 413.1, 251, 253, 434, 435; 137/2; 415/6, 13

(56) References Cited

U.S. PATENT DOCUMENTS 4,086,843 A * 5/1978 Lorimor ..... 91/517
6,071,085 A * 6/2000 Bernhardt ..... 417/251
6,123,516 A * 9/2000 Burghard et al. ..... 417/250
6,248,157 B1 * 6/2001 Sims et al. ..... 96/6
6,305,907 B1 10/2001 Becker et al. ..... 417/53
6,551,082 B2 * 4/2003 Douzono et al. ..... 418/83

FOREIGN PATENT DOCUMENTS

| | | | |
|---|---|---|---|
| DE | 29618911 | 12/1996 | F04B/39/10 |
| DE | 3710782 | 10/1999 | F04C/23/00 |
| DE | 19831123 | 1/2000 | F04B/25/00 |
| DE | 19851680 | 5/2000 | |
| FR | 2082631 | 12/1971 | |
| GB | 923072 | 4/1963 | 32/13 |
| JP | 10231785 A * | 9/1998 | F04B/49/06 |

* cited by examiner

*Primary Examiner*—Charles G. Freay
(74) *Attorney, Agent, or Firm*—Volpe and Koenig, P.C.

(57) ABSTRACT

A multistage device (1) for delivering moist gases is provided. Said device comprises several delivery pumps (2, 3) each of which having a displacer that oscillates inside a delivery space, and being connected in series via a connection channel (6). The inventive device also comprises a ventilation device (7) which has at least one ventilation channel (8), whereby the ventilation channel (8) opens into a connection channel (6) that interconnects series-connected delivery pumps (2, 3). The inventive device (1) is characterized in that a ventilation valve (9), which can be motor-actuated by a control device, is interconnected inside the ventilation channel (8), and said ventilation valve (9) can be actuated as required by means of the control device and independent of the lift position of the displacers.

6 Claims, 1 Drawing Sheet

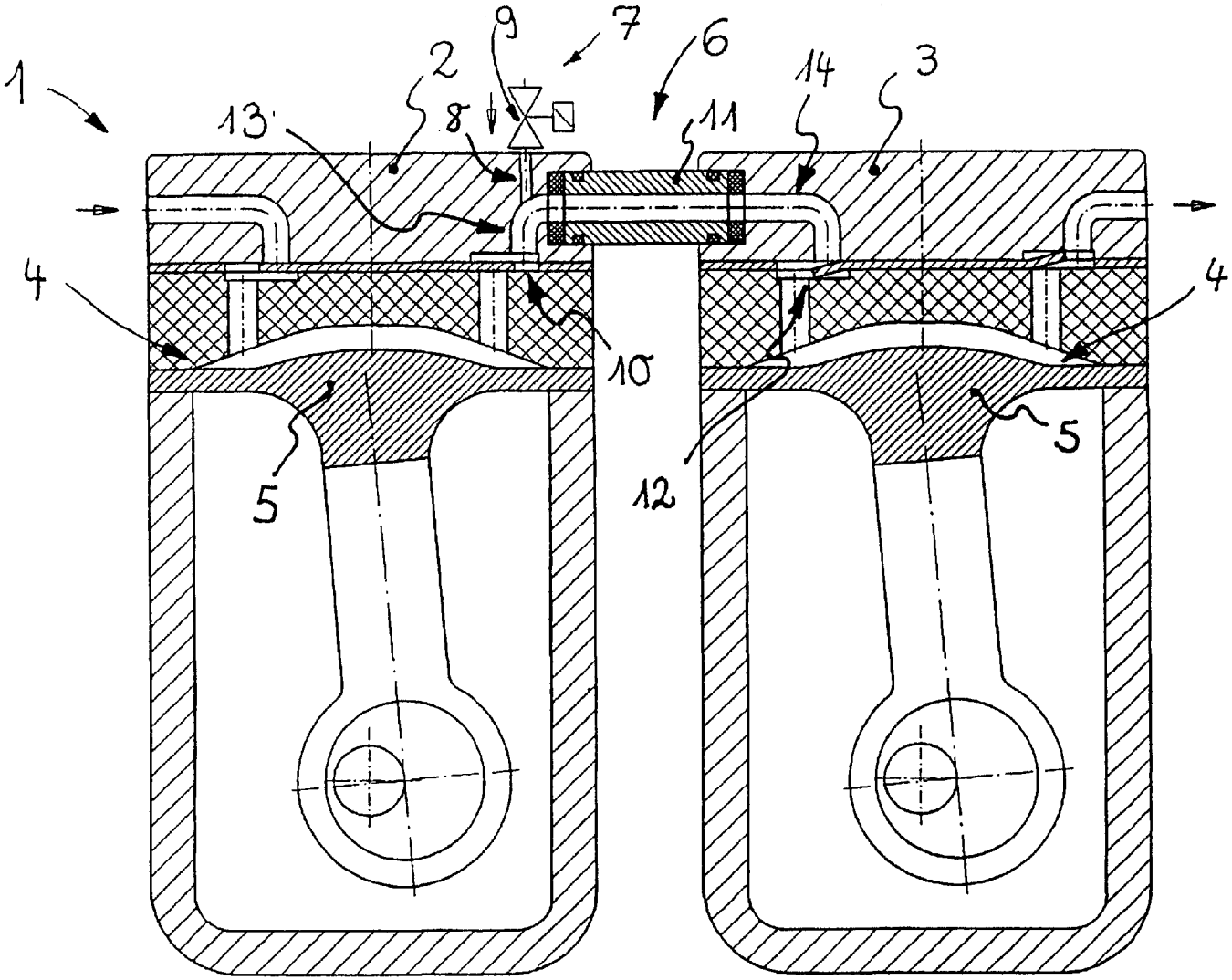
1
2
3
4
4
5
5
6
7
8
9
10
11
12
13
14

DEVICE FOR DELIVERING MOIST GASES

This invention is directed to a multistage device for delivering moist gases, with several delivery pumps, each having a displacer that oscillates inside a delivery space, and being connected in series by a connection channel, as well as with a ventilation device having at least one ventilation channel. The ventilation channel opens into a connection channel that interconnects series-connected delivery pumps.

In the published advance application DE 198 51 680 of the applicant, a device is already described which has at least one delivery pump for the delivery of moist gases. Each of these delivery pumps has a displacer that oscillates inside a delivery space. In order to be able to condense the fluids contained in the gaseous delivery medium, reduce the delivery volumes, and keep the time required, for example, for evacuating a vacuum chamber as short as possible, the pump head of this delivery pump is force cooled. At least one delivery pump features a ventilation device with a ventilation channel which opens into the area of the delivery space. A ventilation valve is interposed inside this ventilation channel, which can be operated, as needed, independently of the lift position of the displacers during the operation of the delivery pump.

When operating the ventilation valve, a precise current with a sufficiently high flow speed is built up, in order to carry away any remaining drops of liquid from the delivery space.

Through the condensation of the moisture contained in the delivery medium, there is a resulting drastic reduction in volume, which allows quick pumping times and high pump delivery rates to be achieved. With the help of the ventilation device in the delivery pumps, a fast and precise drying of the delivery device, also multistage if necessary, can be achieved. This also promotes the shortening of the evacuation time, and the achievable end vacuum can be significantly reduced. The disadvantage, however, is that the device in DE 198 51 680 requires special delivery pumps with pump heads having the ventilation channels opening into the delivery space built into them. This can possibly entail a significant excess expense.

A multistage delivery device is already known from DE 198 31 123 A1, in which the pump stages are connected with each other by a connecting channel serving as an intermediate vacuum space. This previously known delivery device features a ventilation channel opening into the connecting channel and provided with an air regulator. The connecting channel is, on its part, connected to the working space of the first pump stage through an additional air regulator. With the help of this gas ballast device, a sufficient quantity of gas is supposed to be drawn into the working space of the first pump stage, in order to counteract condensation and subsequent evaporation of the water vapor still contained in the gas to be pumped. The construction expense associated with this gas ballast device of the previously known delivery device is also very high, however.

Therefore, the objective is to create a device of the type mentioned above which is also distinguished by a high delivery rate when the delivery medium has a high moisture content, whereby the delivery device according to the invention is also manufactured and constructed at as low a cost as possible.

The solution to this problem according to the invention comprises in particular the interposing a ventilation valve which is motor-activated through a control device. This ventilation valve can be activated by the control device as needed and independently of the lift position of the displacers.

The device according to the invention features a ventilation valve that can be motor activated by a control device. The ventilation valve is interposed in the ventilation channel, which opens into a subsequent connecting channel that interconnects series-connected pump stages. The ventilation valve can be operated by the control device as needed and independently of the lift position of the displacers. In this way, it can be opened during the operation of the delivery device, for example, once or at time intervals several times, intermittently.

The ventilation of the delivery device can take place during its operation, once or several times, periodically, for example, after certain condensation times or at different pressure levels in a chamber to be evacuated by the delivery device. Through ventilation of the delivery device, a precise current with a sufficiently high flow speed is built up in the delivery pumps of the delivery stage following the ventilation channel, in order to carry away the remaining drops of liquid and condensation in the delivery space, from this delivery pump in particular. Since, when opening the ventilation channel, the outlet valve of the delivery stage prior to the ventilation channel closes abruptly at the same time, the ventilation and/or drying gas can flow in one direction only, while the vacuum already achieved in the previous delivery stage, and particularly in the chamber to be evacuated, is essentially maintained.

A special advantage of the delivery device according to the invention is that the ventilation channel can also be directed outside of the pump heads of the delivery pumps and can open into the connecting channel. In such a model of this invention, the manufacturing and construction costs are also significantly reduced.

An especially advantageous and easy to operate model of the invention has a timing element and/or pressure sensor on the control device connected to the ventilation valve, so that the ventilation valve can be activated once or multiple times, intermittently, depending on the condensation time and/or depending on pre-determined levels of pressure in a chamber to be evacuated by the delivery device.

The delivery device according to the invention can be advantageously utilized for all applications involving moisture content. For example, the device is designed so that the delivery pump belonging to the first stage of the inventive delivery device can be connected on the suction side to an autoclave or a vacuum drying chamber, and on the pressure side to the suction side of the second delivery pump.

The construction and manufacturing expense is lower still if the delivery pumps used in the individual stages of the delivery device are regular, commercial pumps, particularly membrane pumps.

A preferable and especially simple to construct version of the invention has a magnetic valve for the ventilation valve that can be motor-activated.

Additional characteristics of the invention can be seen in the following description of preferred embodiment of the invention in connection with the claims as well as the drawing. The individual characteristics can each be implemented by themselves or several together in one version of the invention.

In the single illustration, a two-stage delivery device 1 is shown, which is intended for the delivery of moist, and especially of condensate-containing gases. The delivery device 1 has two delivery pumps 2, 3, each having an oscillating displacer in a delivery space 4. The delivery pumps 2, 3 are constructed here as membrane pumps and their displacers as formed membranes 5.

The delivery pumps 2, 3 are connected to each other by a connecting channel 6. The delivery pump 2, forming the first delivery stage, is connected on the suction side to an autoclave, a vacuum drying chamber or a similar vacuum chamber, and on the pressure side to the suction side of the second delivery pump 3.

The delivery device 1 has a ventilation device 7 with a ventilation channel 8, which opens into the connecting channel 6 between the first and second pump stages. A ventilation valve 9 is interposed in the ventilation channel 8. In order to be able to ventilate the delivery device 1 as needed and independently of the lift position of the delivery pumps 2, 3, the ventilation valve 9 can be opened once or several times at intervals during the operation of the delivery device 1.

The ventilation of the delivery device 1 can take place during its operation, once or several times, at intervals, for example, according to certain condensation times or at different pressure levels within a chamber to be evacuated by the delivery device 1. By ventilating the delivery device 1, a precise current with a sufficiently high flow speed is built up in the delivery pump 3 of the delivery stage following the ventilation channel 8, in order to carry away the remaining drops of fluids and condensation in the delivery space, particularly in the delivery pump 3. Since, when opening the ventilation valve 9, the outlet valve 10 of the previous delivery stage 2 connected to the ventilation channel 8 closes at the same time, the ventilation and/or drying gas can flow in one direction only, while the vacuum already achieved in the previous delivery stage 2, and especially in the chamber to be evacuated, is essentially preserved.

The connecting channel 6 features a channel section constructed of a pipe or hose line 11, as well as one in each of the pump heads of the delivery pumps 2, 3 between the hose line 11 and the outlet and/or inlet valve 10, 12 located in the channel section 13, 14.

The ventilation channel 8 is located here in the pump head of the first delivery pump 2 and opens into the channel section 13 located on the outlet flow side behind the outlet valve 10. It is, however, a especially advantagous that the ventilation channel 8 can also go outside of the pump heads of delivery pumps 2, 3 and can open into the hose line 11.

Since condensate occurs primarily in the second delivery stage (which compresses against atmospheric pressure) formed by the delivery pump 3, the ventilation device 7 assigned to the delivery pump 3 is sufficient. If the ventilation valve 9 is opened, the outlet valve 10 of the first delivery pump 2 closes automatically, so that no loss of time or power occurs. By the delivery device 1 illustrated here, moist gases can also be delivered without the need for an artificial heating of the delivery pumps 2, 3 for combating the build up of condensation. The delivery device 1 provided here is also distinguished by a high delivery rate even with a high moisture content of the delivery medium. This delivery device 1 accomplishes this without needing special delivery pumps and a correspondingly high manufacturing and construction cost.

What is claimed is:

1. Multistage vacuum pump device (1) for evacuation of moist gases comprising a plurality of delivery pumps (2,3) forming at least a first stage connected to a chamber to be evacuated and a second stage, each of the stages having a displacer that oscillates inside a delivery space and connected in series by a connection channel (6) and a condensate ventilation device (7), which has at least one ventilation channel (8), the ventilation channel (8) opens into the connection channel (6) that interconnects the series-connected delivery pumps (2,3) and a ventilation valve (9) is interposed in the ventilation channel that is motor-activated by a control device, the ventilation valve (9) being operated by the control device as needed and independently of a lift position of the displacers.

2. Device according to claim 1, characterized in that the control device connected to the ventilation valve (9) includes a timing element and/or a pressure sensor for a one-time or a repeated, intermittent operation of the ventilation valve (9), depending on a condensation time and/or depending on pre-determined pressure levels in the chamber to be evacuated by the device (1).

3. Device according to claim 1, characterized in that the delivery pump (2) of the first stage is connected on a suction side to an autoclave or to a vacuum drying chamber, and connected on a pressure side to a suction side of the second delivery pump (3).

4. Device according to claim 1, characterized in that the delivery pumps (2, 3) used in the individual stages of the device (1) are membrane pumps.

5. Device according to claim 1, characterized in that the motor-activated ventilation valve is a magnetic valve.

6. Device according to claim 1, characterized in that an outlet valve in the first stage automatically closes if the ventilation valve is open, acting as a non-return valve.

* * * * *